US010888159B1

(12) United States Patent
Lin

(10) Patent No.: US 10,888,159 B1
(45) Date of Patent: Jan. 12, 2021

(54) EXTENSION CONNECTING STRUCTURE FOR A CHAIR LEG

(71) Applicant: Spec Seats Technologies Inc., Taoyuan (TW)

(72) Inventor: Mei Chuen Lin, Taoyuan (TW)

(73) Assignee: Spec Seats Technologies Inc., Taoyuan (TW)

( * ) Notice: Subject to any disclaimer, the term of this patent is extended or adjusted under 35 U.S.C. 154(b) by 0 days.

(21) Appl. No.: 16/547,066

(22) Filed: Aug. 21, 2019

(51) Int. Cl.
*A47B 91/00* (2006.01)
*A47C 7/00* (2006.01)

(52) U.S. Cl.
CPC ..... *A47B 91/00* (2013.01); *A47C 7/002* (2013.01)

(58) Field of Classification Search
CPC ..... A47B 91/00; A47C 7/002
USPC ..... 297/463.1, 463.2
See application file for complete search history.

(56) References Cited

U.S. PATENT DOCUMENTS

| | | | | |
|---|---|---|---|---|
| 5,513,900 | A * | 5/1996 | Iglesias | A47C 7/002 297/463.1 |
| 5,799,921 | A * | 9/1998 | Stattel | A47B 97/00 297/463.1 |
| 2007/0170760 | A1* | 7/2007 | Peterson | A47C 7/002 297/310 X |
| 2014/0203619 | A1* | 7/2014 | Dapra | A47C 7/008 297/463.1 |

* cited by examiner

*Primary Examiner* — Anthony D Barfield
(74) *Attorney, Agent, or Firm* — Wang Law Firm, Inc.

(57) ABSTRACT

The present invention provides an extension connecting structure for mounting onto a chair leg. The extension connecting structure includes a connecting plate, a base plate and a connecting part. An end of the connecting plate is connected to the base plate. The connecting part is disposed at another end of the connecting piece. The connecting part is configured to mount the chair leg. As such, the supporting strength of the chair leg may be reinforced by the connecting plate and the base plate. In such a way, the chair may be prevented from falling backwards due to the unstable center of gravity, and the user may be prevented from getting injured.

9 Claims, 12 Drawing Sheets

EXTENSION CONNECTING STRUCTURE FOR A CHAIR LEG

BACKGROUND OF THE INVENTION

1. Field of the Invention

The present invention relates generally to an extension connecting structure, more particularly, relates to an extension connecting structure for a chair leg of a foldable chair. The extension connecting structure may reinforcing the supporting strength of the chair leg to prevent the chair from falling backward.

2. The Prior Arts

Foldable chairs are a type of chairs that may be folded and put away. When not in use, a foldable chair may be folded to save space to facilitate easy storage and transportation.

FIG. 1 is a side view of a conventional foldable chair. As shown in FIG. 1, a conventional foldable chair includes a front chair frame 90, a cushion pad 92 and a rear chair frame 93. The front chair frame includes a seat back 91. With the pivotal connection between the front chair frame 90 and the rear chair frame 93 and the pivotal connection between the front chair frame 90 and the cushion pad 92, the conventional foldable chair is rotatable and foldable.

Nevertheless, such a conventional foldable chair is disadvantageous in that its center of gravity is offset. Based on the side view of the conventional foldable chair, it can be seen that position A is assumed at the top of the seat back 91 of the foldable chair. Position C is located at a position where the hypothetical line from position A perpendicularly extended to a ground surface 85. Position C is distanced from position B of the rear chair frame 93 with a distance D, so the center of gravity of the conventional foldable chair is located at position B of the rear chair frame 93. When the user leans backwards while sitting on the foldable chair, he or she may fall backwards due to the unstable center of gravity.

Furthermore, another type of conventional foldable chair may include a cushion pad 92 with a rebound feature, in which the cushion pad 92 would bounce back to a folded position when the user leaves the cushion pad 92. If a user sits down onto the chair without noticing that the cushion pad 92 has already bounced back, he or she may fall backwards with the chair due to the unstable center of gravity and may become injured.

SUMMARY OF THE INVENTION

Due to the foregoing reasons, a primary objective of the present invention is to provide an extension connecting structure for mounting onto a chair leg of a foldable chair. In such a way, the supporting strength of the chair leg may be reinforced, and the chair may be prevented from falling backward.

For achieving the foregoing objectives, the present invention provides an extension connecting structure for mounting onto a chair leg. The extension connecting structure comprises a connecting plate, a base plate and a connecting part.

Herein, an end of the connecting plate is connected to the base plate. The connecting part is disposed at another end of the connecting piece. The connecting part is configured to mount the chair leg.

In one embodiment of the present invention, the extension connecting structure further comprises a pin, and the connecting part further comprises a connecting piece, a first extension piece and a second extension piece. Herein, the first extension piece and the second extension piece are respectively provided on two sides of the connecting piece and are respectively provided with a hole. The pin is configured to pass through the holes so that the chair leg is mounted between the connecting piece, the first extension piece, the second extension piece and the pin.

Preferably, the pin further comprises a lever portion and a pin portion. The lever portion is formed at an end of the pin portion, and another end of the pin portion is configured to pass through the holes of the first extension piece and the second extension piece.

Herein, an angle is formed between the lever portion and the pin portion.

In one embodiment of the present invention, the pin portion further comprises a positioning portion protruding from the pin portion. The first extension piece includes a first insertion hole which is in spatial communication with the hole of the first extension piece. When the pin passes through the hole of the first extension piece, the positioning portion is configured to pass through the first insertion hole, and the lever portion of the pin is configured to fitted against a side of the first extension piece. A first distance is provided between the positioning portion and another side of the first extension piece, a second distance is provided between an end of the pin portion and a side face of the second extension piece that is facing the first extension piece, and the second distance is greater than the first distance.

Preferably, the second extension piece comprises a second insertion hole which is in spatial communication with the hole of the second extension piece. When the pin passes through the hole of the second extension piece, the positioning portion is configured to pass through the second insertion hole, and the lever portion of the pin is configured to fitted against a side of the second extension piece. A third distance is provided between the positioning portion and another side of the second extension piece, a fourth distance is provided between an end of the pin portion and a side face of the second extension piece that is facing the first extension piece, and the fourth distance is greater than the third distance.

Preferably, the first extension piece and the second extension piece are perpendicular to the connecting plate.

In one embodiment of the present invention, an angle is formed between the connecting plate and the base plate, and the angle is equal to an angle between the chair leg and a ground surface.

In one embodiment of the present invention, the base plate comprises a rib portion protruding from a midsection thereof.

In one embodiment of the present invention, the base plate comprises a first side and a second side, the connecting plate is disposed at the first side of the base plate.

In one embodiment of the present invention, the base plate comprises a first side and a second side, the connecting plate is disposed at the second side of the base plate.

The present invention is advantageous in that by mounting the connecting structure onto the chair leg via the connecting part, the supporting strength of the chair leg may be reinforced by the connecting plate and the base plate. In such a way, the chair may be prevented from falling backwards due to the unstable center of gravity.

Further, the present invention may also prevent the user from being injured when he or she sits down onto a foldable chair in which the cushion pad has bounced back to the folded position. In such a situation, the chair would not fall backwards due to an unstable center of gravity.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
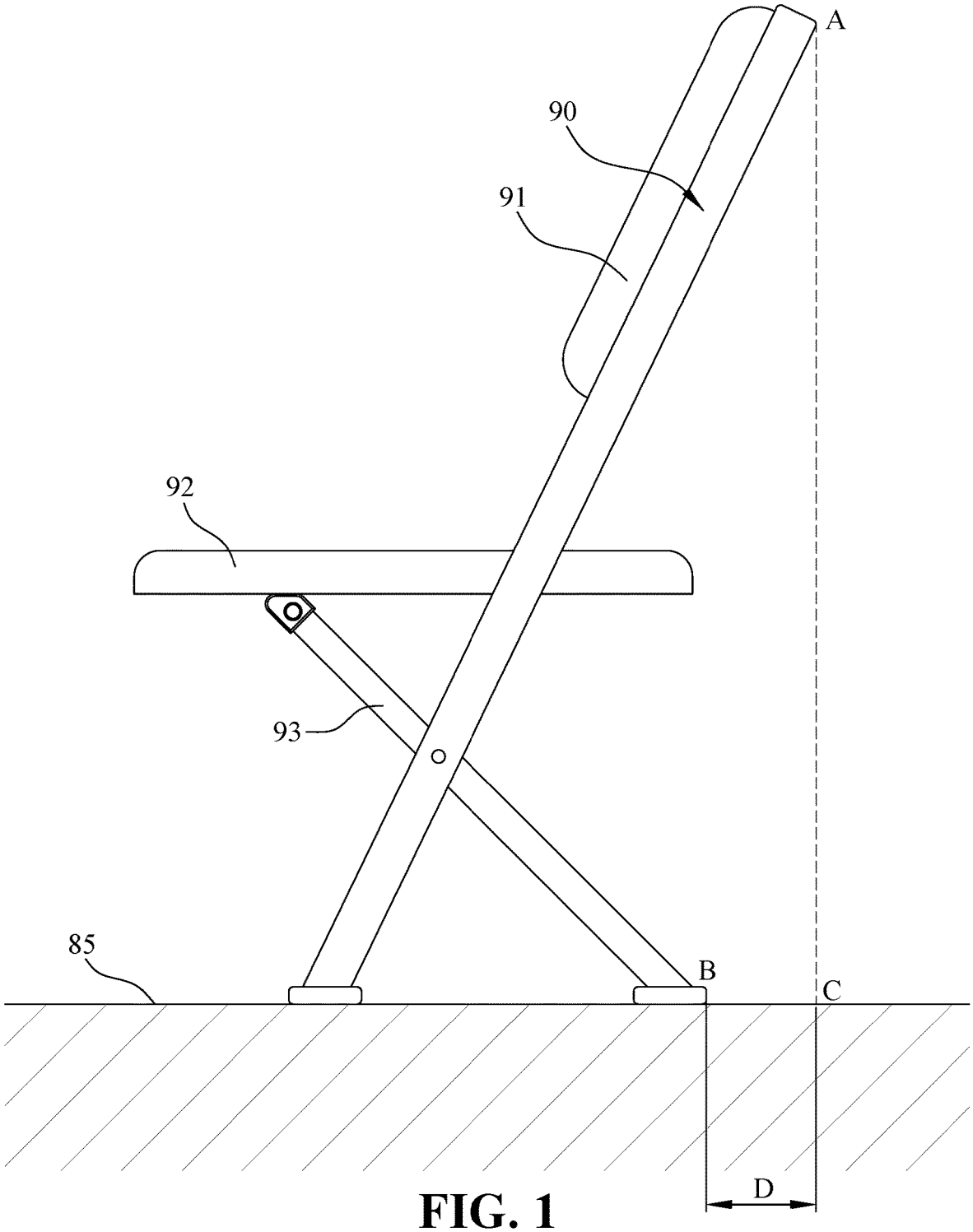
FIG. 1 (PRIOR ART)
FIG. 1 is a side view illustrating a conventional foldable chair.
Figure 2:
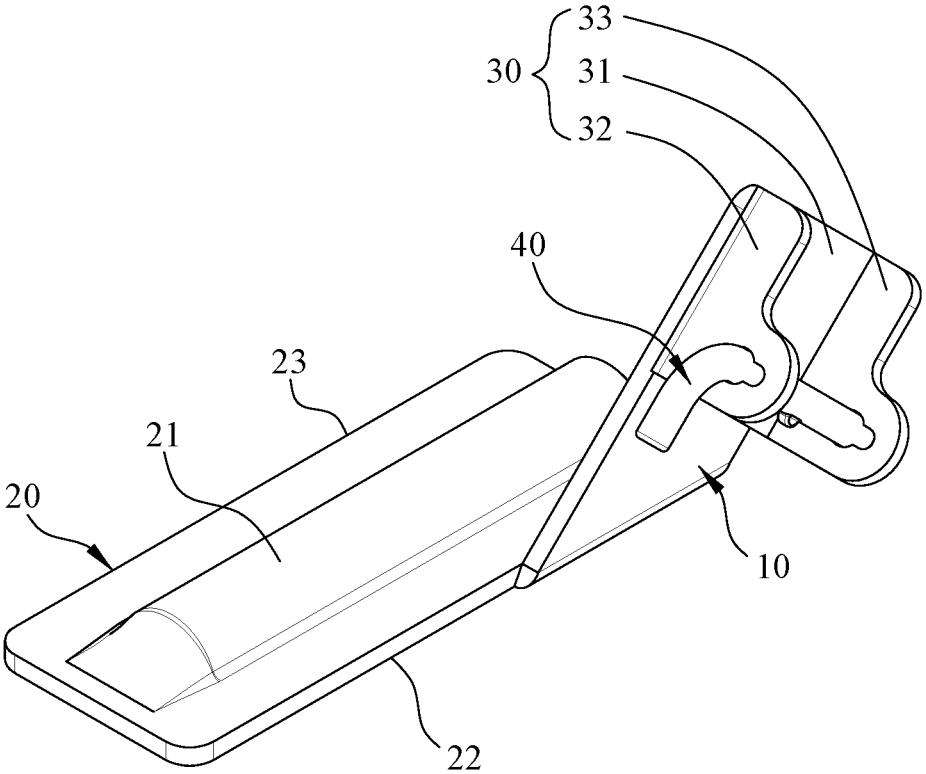
FIG. 2 is a perspective and assembled view illustrating an extension connecting structure according to a first embodiment of the present invention.
Figure 3:
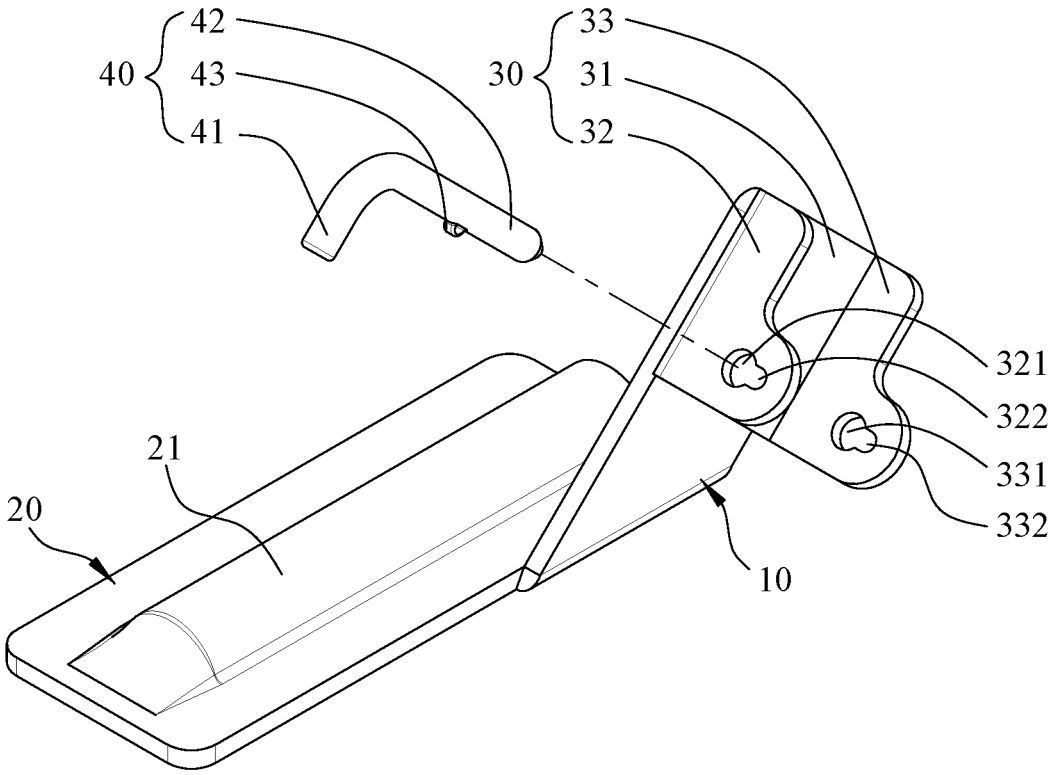
FIG. 3 is a perspective and exploded view illustrating the extension connecting structure according to a first embodiment of the present invention.

FIG. 2 is a perspective and assembled view of an extension connecting structure according to a first embodiment of the present invention. FIG. 3 is a perspective and exploded view of the extension connecting structure according to the first embodiment of the present invention. As shown in FIGS. 2 and 3, the present invention provides an extension connecting structure for mounting onto one of chair legs 80 (shown in FIG. 5) of the rear chair frame 93. The extension connecting structure comprises a connecting plate 10, a base plate 20 and a connecting part 30. Each component will be described in further details in the following sections.

An end of the connecting plate 10 is connected to the base plate 20. The connecting part 30 is disposed at another end of the connecting plate 10 that is opposite from the base plate 20. In the first embodiment of the present invention, the base plate 20 further includes a rib portion 21 protruding from a midsection of the base plate 20. The rib portion 21 may reinforce the strength of the base plate 20. In the first embodiment of the present invention, the based plate 20 includes a first side 22 and a second side 23, and the connecting plate 10 is disposed on the first side 22 of the base plate 20.

The connecting part 30 includes a connecting piece 31, a first extension piece 32 and a second extension piece 33. The first extension piece 32 and the second extension piece 33 are provided at two sides of the connecting piece 31. Preferably, the first extension piece 32 and the second extension piece 33 are perpendicular to the connecting plate 10, respectively, so that a gap is formed between the first extension piece 32 and the seconding connecting piece 33 for accommodating a chair leg 80 (shown in FIG. 5). Herein, in the first embodiment of the present invention, the first extension piece 32 is formed with a first insertion hole 322 and a hole 321. The first insertion hole 322 is in spatial communication with the hole 321. The second extension piece 33 is formed with a hole 331.

In the first embodiment of the present invention, the extension connecting structure further comprises a pin 40. The pin 40 includes a lever portion 41 and a pin portion 42. The lever portion 41 is formed at an end of the pin portion 42. An outer diameter of the pin portion 42 is smaller than the hole 321 of the first extension piece 32 and the hole 331 of the second extension piece 33, so the pin portion 42 may pass through the hole 321 of the first extension piece 32 and the hole 331 of the second extension piece 33.

Herein, in the first embodiment of the present invention, the pin 40 further includes a positioning portion 43 protruding from the pin portion 42. When the pin portion 42 passes through the hole 321 of the first extension piece 32, the positioning portion 43 may also be inserted through the first insertion hole 322.

Figure 4:
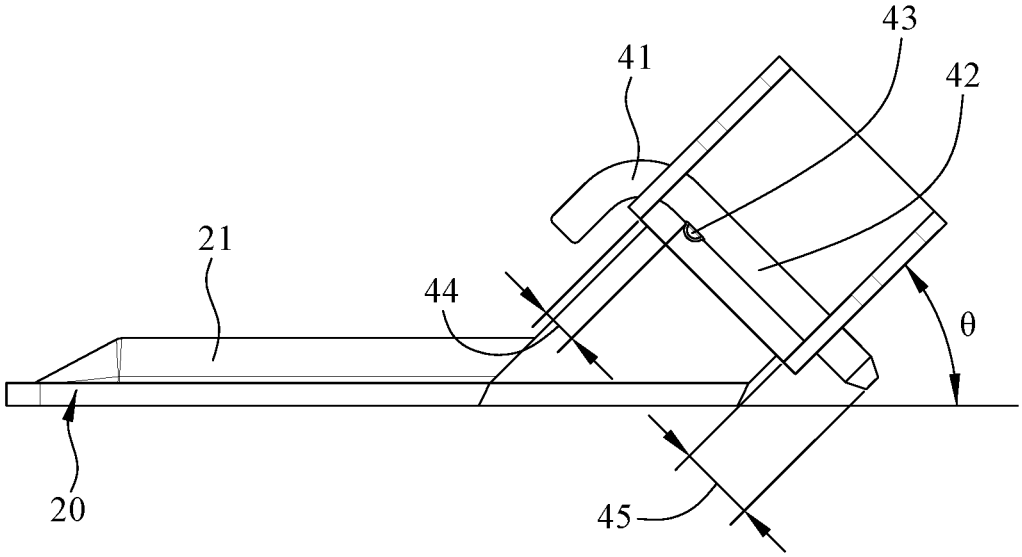
FIG. 4 is a side view illustrating the extension connecting structure according to a first embodiment of the present invention.

FIG. 4 is a side view illustrating the extension connecting structure according to the first embodiment of the present invention. As shown in FIG. 4, when the pin portion 42 and the positioning portion 43 of the pin are inserted through the hole 321 and the first insertion hole 322 of the first extension piece 32, the lever portion 41 of the pin 40 is fitted against a side of the first extension piece 32. At this time, a first distance 44 is formed between the positioning portion 43 and another side of the first extension piece 32, and a second distance 45 is formed between an end of the pin portion 42 and a side surface of the second extension piece 33 that is facing the first extension piece 32. Preferably, the second distance 45 is greater than the first distance 44.

In the first embodiment of the present invention, an angle is formed between the lever portion 41 and the pin portion 42. In such a way, when an end of the pin portion 42 is inserted through the hole 321 of the first extension piece 32 and the hole 331 of the second extension piece 33 in the same order, the lever portion 41 is fitted against a side of the first extension piece 32. The lever portion 41 realizes the positioning effect of the pin 40 so that the pin 40 may be positioned in the hole 321 of the first extension piece 32 and the hole 331 of the second extension piece 33.

Preferably, the angle between the lever portion 41 and the pin portion 42 may be 90°; however, the angle between the lever portion 41 and the pin portion 42 is not limited thereto.

It is worth mentioning that an angle θ is formed between the connecting plate and the base plate 20 in the first embodiment of the present invention. The angle θ equals to the angle between the chair leg 80 and the ground surface 85, so that the connecting part 30 may be connected to the chair leg 80.

Figure 5:
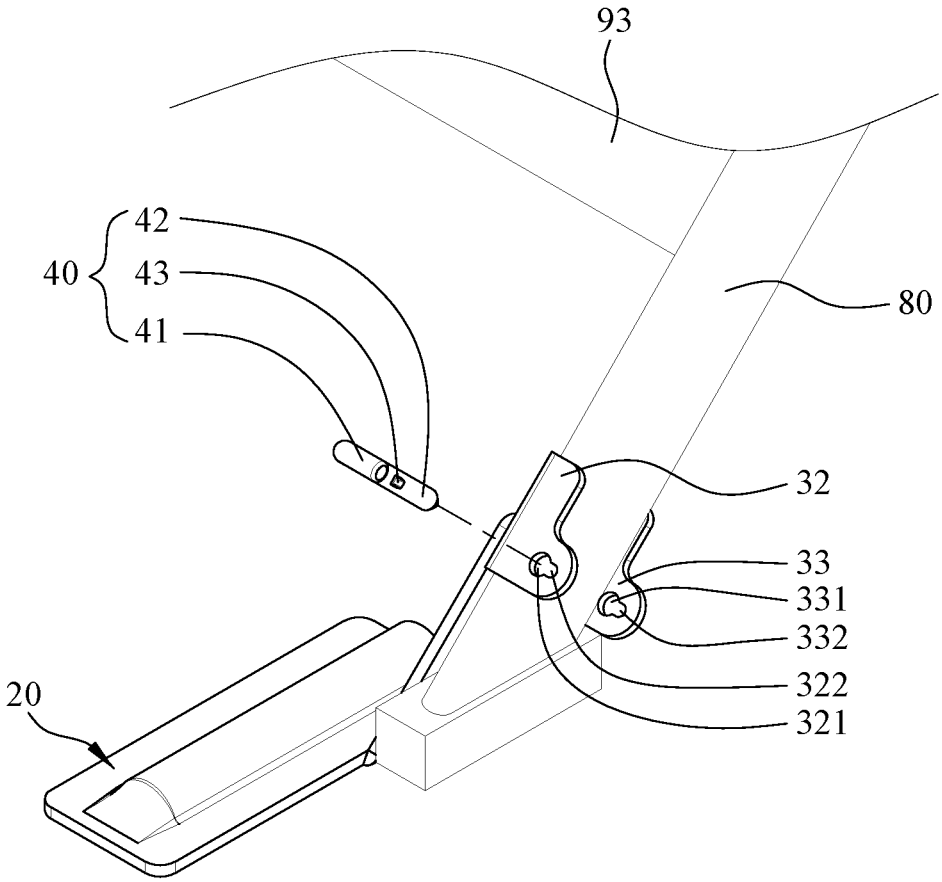
FIGS. 5, 6 and 7 are schematic views illustrating a first mounting method of the extension connecting structure according to a first embodiment of the present invention.
Figure 6:
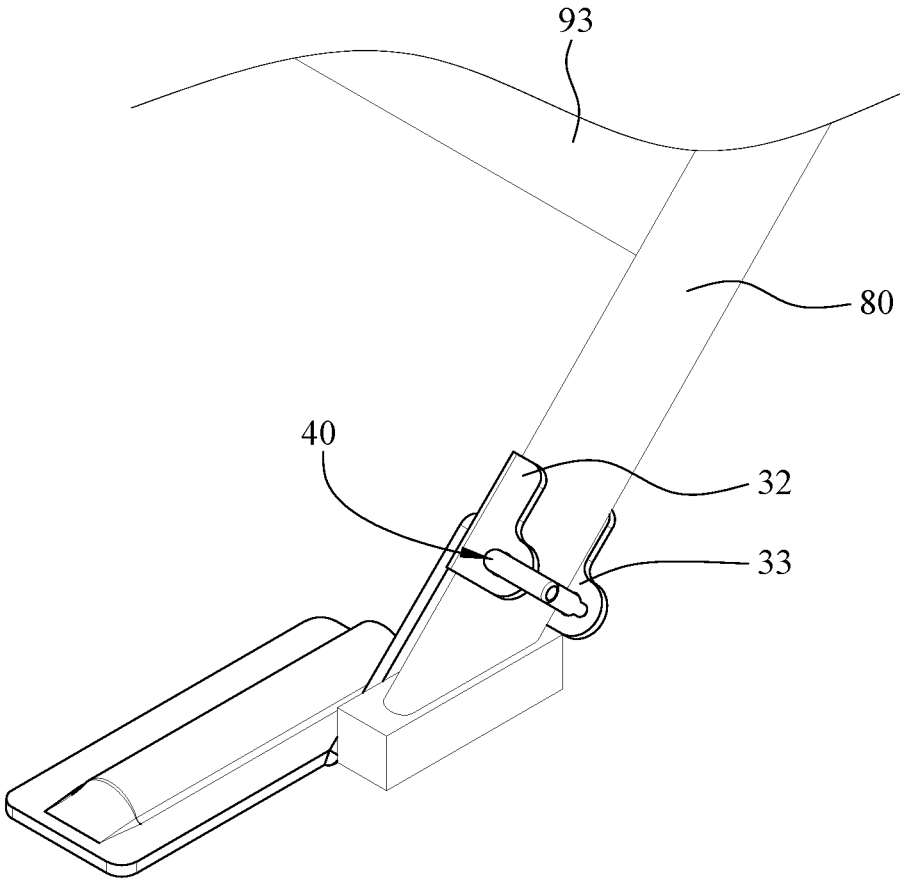
Figure 7:
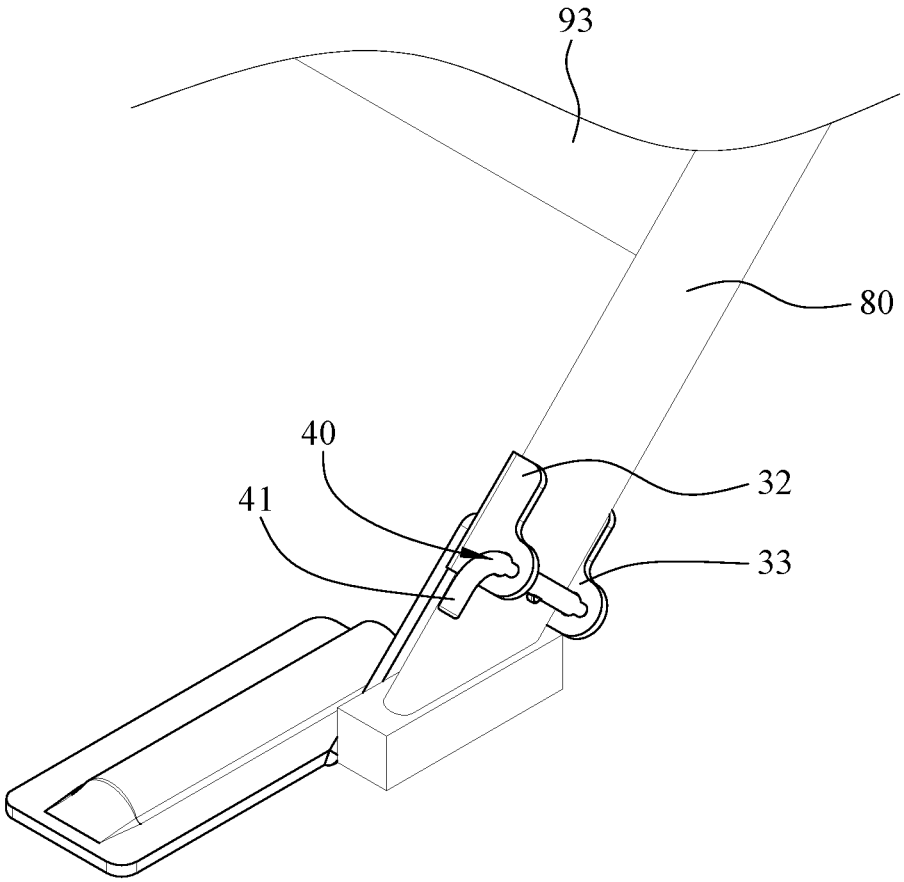
Figure 8:
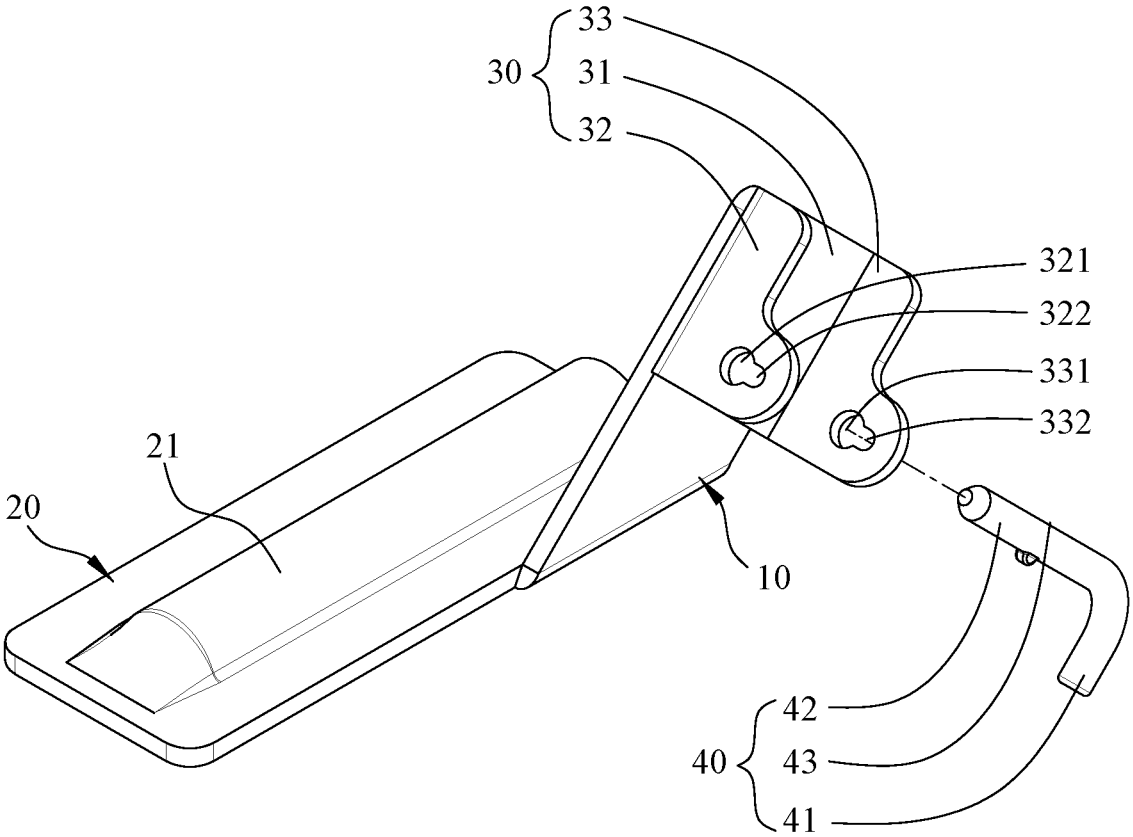
FIG. 8 is a schematic view illustrating a second mounting method of the extension connecting structure according to a first embodiment of the present invention.
Figure 9:
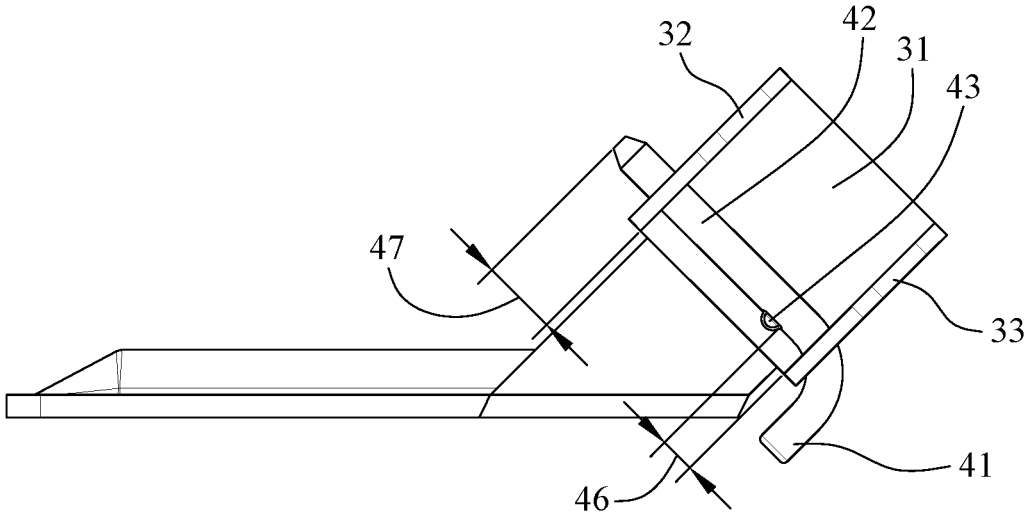
FIG. 9 is a side view illustrating a second mounting method of the extension connecting structure according to a first embodiment of the present invention.

FIGS. 5, 6 and 7 are schematic views illustrating a first mounting method of the extension connecting structure according to the first embodiment of the present invention. As shown in FIGS. 5, 6 and 7, in the first mounting method of the present invention, the chair leg 80 is disposed between the connecting piece 31, the first extension piece 32 and the second extension piece 33. Then, the pin 40 is aligned with the hole 321 of the first extension piece 32, the positioning portion 43 is aligned with the first insertion hole 322 of the first extension piece 32 before the pin 40 is inserted therein. The pin portion 43 and the positioning portion 43 are then inserted through the hole 321 and the first insertion hole 322, and an end of the pin portion 42 is inserted through the hole of the second extension piece 33. In such a way, the chair leg 80 is fixed between the connecting piece 31, the first extension piece 32, the second extension piece 33 and the pin 40, thereby mounting the chair leg 80.

At this time, the user may rotate the pin 40 so that the positioning 43 is not aligned with the first insertion hole 322. When the pin 40 is pulled, the positioning portion 43 is abutted against another side of the first extension piece so the positioning portion 43 is unable to be removed from the first insertion hole 322. Thus, the pin 40 is prevented from being disconnected from the connecting part 30.

The present invention provides a second mounting method of the extension connecting structure. In the second mounting method, a second insertion hole 332 is provided on the second extension piece 33. The user may insert the pin 40 through the hole 331 of the second extension piece 33 and the hole 321 of the first extension piece from different directions, so the chair leg 80 is fixed between the connecting piece 31, the first extension piece 32, the second extension piece 33 and the pin 40, thereby mounting the chair leg 80.

Figure 10:
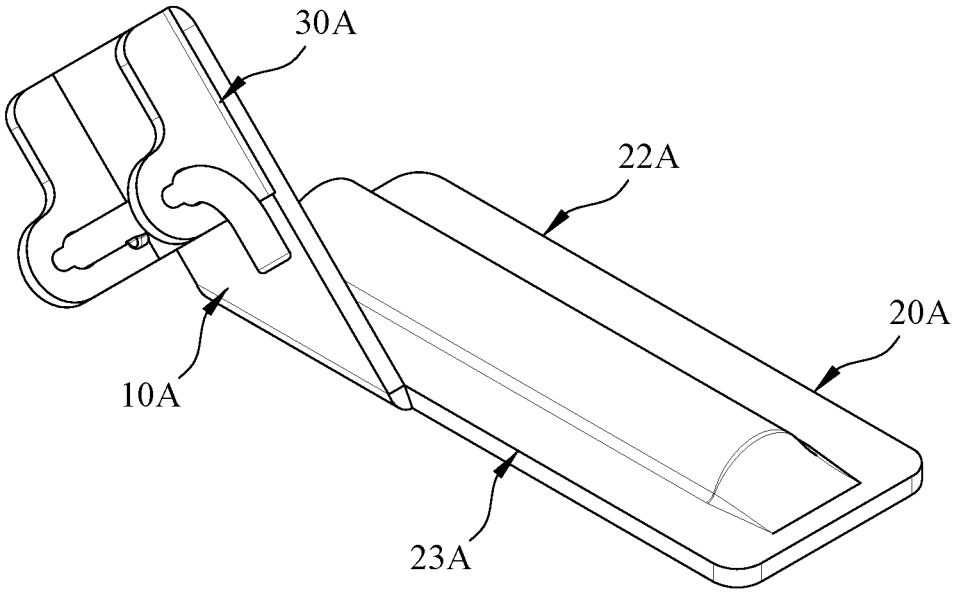
FIG. 10 is a perspective and assembled view illustrating the extension connecting structure according to a second embodiment of the present invention.

FIG. 10 is a perspective and assembled view illustrating the extension connecting structure according to a second embodiment of the present invention. The second embodiment of the present invention is different from the first embodiment in that the base plate 20A includes a first side 22A and a second side 23A, and the connecting plate 10A is disposed on the second side 23A of the base plate 20A. The connecting part 30A is disposed on another end of the connecting plate 10A that is opposite from the base plate 20A. By disposing the connecting plate 10A on the second side 23A of the base plate 20A, the extension connecting structure according to the second embodiment of the present invention may be mounted onto another char leg 80 of the rear chair frame 93.

Figure 11:
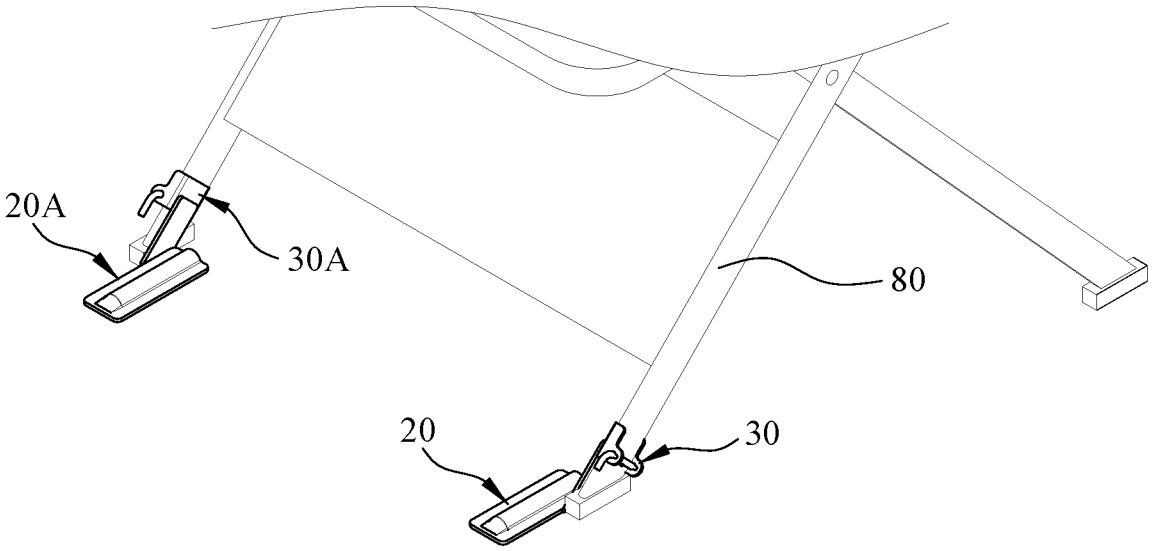
FIG. 11 is a schematic view illustrating the extension connecting structures according to the first and second embodiments being respectively mounted to the chair legs of the rear chair frame.
Figure 12:
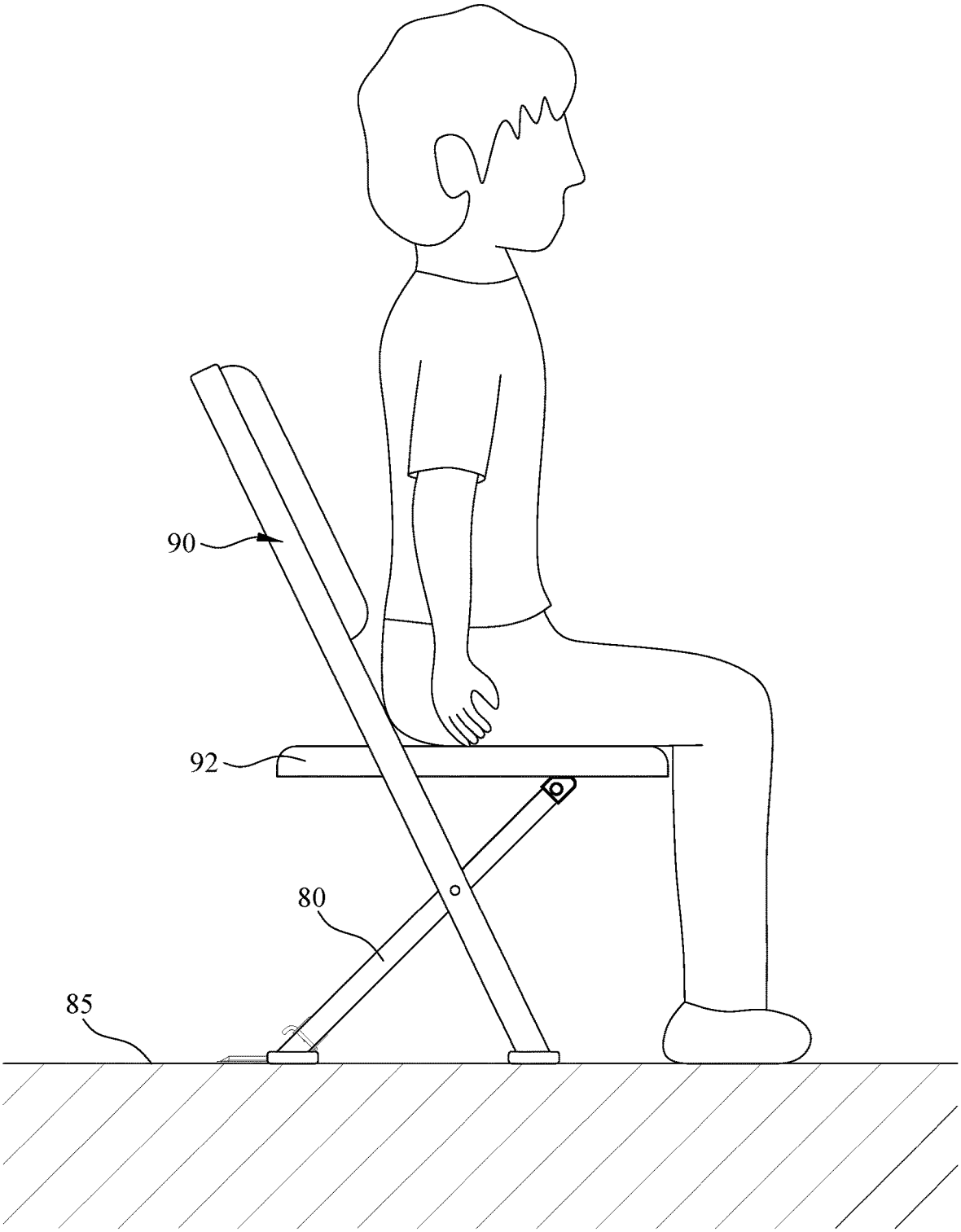
FIG. 12 is a schematic view illustrating a user sitting on the foldable chair with the extension connecting structures according to the first and second embodiments of the present invention.

FIG. 11 is a schematic view illustrating the extension connecting structures according to the first and second embodiments being respectively mounted to the chair legs of the rear chair frame. FIG. 12 is a schematic view illustrating a user sitting on the foldable chair with the extension connecting structures according to the first and second embodiments of the present invention. As shown in FIGS. 11 and 12, in particular, the extension connecting structure according to the first embodiment of the present invention is mounted onto the right chair leg 80 of the rear chair frame 93, and the extension connecting structure according to the second embodiment of the present invention is mounted onto the left chair leg 80 of the rear chair frame 93, thereby providing better support for the chair. In addition, through the support of the extension connecting structure of the present invention, When the user leans backwards while sitting on the foldable chair, he or she would not fall backwards due to the unstable center of gravity and may be prevented from getting injured.

The present invention is advantageous in that by mounting the connecting structure onto the chair leg 80 via the connecting part 30, the supporting strength of the chair leg 80 may be reinforced by the connecting plate 10 and the base plate 20. In such a way, the chair may be prevented from falling backwards due to the unstable center of gravity.

Further, the present invention may also prevent the user from being injured when he or she sits down onto a foldable chair in which the cushion pad 92 has bounced back to the folded position. In such a situation, the chair would not fall backwards due to an unstable center of gravity.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An extension connecting structure for mounting onto a chair leg, comprising:

a connecting plate, a base plate and a connecting part, wherein an end of the connecting plate is connected to the base plate, the connecting part is disposed at another end of a connecting piece, the connecting part is configured to mount the chair leg;

a pin and the connecting part further comprising a connecting piece, a first extension piece and a second extension piece, wherein the first extension piece and the second extension piece are respectively provided on two sides of the connecting piece and are respectively provided with a hole, the pin is configured to pass through the holes so that the chair leg is mounted between the connecting piece, the first extension piece, the second extension piece and the pin; and wherein the pin further comprises a lever portion and a pin portion, the lever portion is formed at an end of the pin portion, and another end of the pin portion is configured to pass through the holes of the first extension piece and the second extension piece.

2. The extension connecting structure according to claim 1, wherein an angle is formed between the lever portion and the pin portion.

3. The extension connecting structure according to claim 1, wherein the pin portion further comprises a positioning portion protruding from the pin portion, the first extension piece includes a first insertion hole which is in spatial communication with the hole of the first extension piece, when the pin passes through the hole of the first extension piece, the positioning portion is configured to pass through the first insertion hole, and the lever portion of the pin is configured to be fitted against a side of the first extension piece, wherein a first distance is provided between the positioning portion and another side of the first extension piece, a second distance is provided between an end of the pin portion and a side face of the second extension piece that is facing the first extension piece, and the second distance is greater than the first distance.

4. The extension connecting structure according to claim 3, wherein the second extension piece comprises a second insertion hole which is in spatial communication with the hole of the second extension piece, when the pin passes through the hole of the second extension piece, the positioning portion is configured to pass through the second insertion hole, and the lever portion of the pin is configured to fitted against a side of the second extension piece, wherein a third distance is provided between the positioning portion and another side of the second extension piece, a fourth distance is provided between an end of the pin portion and a side face of the second extension piece that is facing the first extension piece, and the fourth distance is greater than the third distance.

5. The extension connecting structure according to claim 1, wherein the first extension piece and the second extension piece are perpendicular to the connecting plate.

6. The extension connecting structure according to claim 1, wherein an angle is formed between the connecting plate and the base plate, and the angle is equal to an angle between the chair leg and a ground surface.

7. The extension connecting structure according to claim 1, wherein the base plate comprises a rib portion protruding from a midsection thereof.

8. The extension connecting structure according to claim 1, wherein the base plate comprises a first side and a second side, the connecting plate is disposed at the first side of the base plate.

9. The extension connecting structure according to claim 1, wherein the base plate comprises a first side and a second side, the connecting plate is disposed at the second side of the base plate.

* * * * *